United States Patent [19]

Davis et al.

[11] Patent Number: 4,607,726

[45] Date of Patent: Aug. 26, 1986

[54] LADDER EXTENSION

[76] Inventors: Richard J. Davis; Vince J. Skandunas, both of 6314 Caminito Basilio, San Diego, Calif. 92111

[21] Appl. No.: 674,650

[22] Filed: Nov. 26, 1984

Related U.S. Application Data

[63] Continuation-in-part of Ser. No. 486,710, Apr. 20, 1983, abandoned.

[51] Int. Cl.[4] ..... E06C 7/44

[52] U.S. Cl. ..... 182/204; 248/188.8

[58] Field of Search ..... 182/204, 203, 210, 214, 182/201; 248/188.2, 188.5, 188.8

[56] References Cited

U.S. PATENT DOCUMENTS

| | | | |
|---|---|---|---|
| 1,393,536 | 10/1921 | Hunt | 182/203 |
| 1,508,392 | 9/1924 | Heun | 248/210 |
| 2,680,554 | 6/1954 | Dakin | 182/214 |
| 2,783,928 | 3/1957 | Cox | 182/203 |
| 3,165,170 | 1/1965 | Blaney | 182/203 |
| 3,394,774 | 7/1968 | Lanier | 182/204 |
| 3,414,082 | 12/1968 | Gilland | 182/204 |
| 3,474,883 | 10/1969 | Weis | 182/204 |
| 3,559,939 | 2/1971 | Luna | 248/210 |
| 3,568,801 | 3/1971 | Werner | 182/214 |
| 4,236,603 | 12/1980 | Talley | 182/204 |
| 4,423,797 | 1/1984 | Batten | 182/204 |

*Primary Examiner*—Reinaldo P. Machado

*Attorney, Agent, or Firm*—Brown, Martin & Haller

[57] ABSTRACT

The present invention is a leveling device for removable attachment to a ladder. The device consists of a hollow sleeve member of substantially rectangular cross-section having a pair of side walls joined by a pair of end walls. Each end wall has a plurality of orifices therein such that each orifice on one end wall is paired with an axially aligned orifice on the other end wall. A pair of substantially L-shaped brackets are affixed to opposite ones of the end walls at opposite ends of the sleeve member. Each one of the L-shaped brackets has an arm member extending from a different one of the end walls and an ear member extending substantially perpendicular from the arm member. The ear members are inwardly opposed and spaced from the sleeve member by the arm members so as to receive a ladder rail therebetween. Each of the ear members has a U-shaped notch for receiving ladder rung therein. Spacing means are mounted upon the sleeve member for spacing a ladder rail apart from the sleeve member. An extension member is slidably mounted within the sleeve member. The extension member has a pair of sides each having a plurality of orifices therein such that each orifices on one side is paired with an axially aligned orifice on the other side. A retaining pin extends through a pair of end wall orifices and a pair of side wall orifices when axially therebetween so as to retain the extension member within the sleeve member and effectively extend the ladder rail length.

16 Claims, 8 Drawing Figures

LADDER EXTENSION

CROSS REFERENCE TO RELATED APPLICATIONS

This application is a continuation-in-part application of application Ser. No. 486,710 filed Apr. 20, 1983 and now abandoned.

BACKGROUND OF THE INVENTION

The present invention relates to a removable attachment for ladders which permits the extension of one rail of a ladder. The present invention permits the ladder rungs to remain level when the ladder rails are positioned upon an uneven surface.

In occupation such as construction, painting, utility servicing, building maintenance and other occupations wherein a ladder is required to perform the work, ladder placement is often a problem. Many times the ladder must be placed upon uneven or inclined surfaces for the work to be performed. At times common obstacles such as stair steps may interfer with a desirable ladder placement.

However, for a ladder to perform its intended function in a safe manner the ladder rails must be situated in a vertical position. A ladder placed upon an uneven surface raises the chances of a worker injury due to a ladder related failure. When a ladder is placed upon an uneven surface and a worker scales the ladder, serious injury may result to the worker because of a fall caused by the tilt in the ladder. The fall is usually caused by the center of gravity being offset from a point centrally located between the pair of ladder rails. As the worker scales a ladder placed on a uneven surface, a natural shift in the ladder center of gravity occurs. The ladder will pivot about one rail when the center of gravity extends outside of a ladder rail, thus causing the ladder and worker to fall.

In the past, items such as phone books, rocks, and pieces of lumber if available, were commonly placed under one leg of an otherwise tilting ladder. Use of such items may result in insufficient stability in the ladder, therefore, resulting in an accident. In addition, workers who constantly use ladders need a device that will not affect, such as by removal, the use of a ladder when placed upon a level surface.

Ladder levelers generally tend to fall into two categories. One category is the type of ladder levelers that are permanently affixed to a ladder. The other category being the type of ladder levelers that may be readily detached from the ladder when not needed. In most applications the worker prefers a ladder leveler which falls into the latter category. This is due to the simple fact that the worker need not make adjustments or deal with the ladder leveler when the ladder is placed upon a level surface. When confronted with the situation wherein the ladder must be placed upon an uneven surface, the worker desires a ladder levelling device that may be easily and readily attached thereto. Another consideration for ladder levelers is that the device have an optimized incremental adjustment in the extension of the ladder rail, so as to fully compensate for the uneven surface. Optimized incremental adjustment of the ladder leveler is required to place the ladder rails in a vertical position by effectively extending the length of the rail positioned upon the lower surface.

The typical removable ladder leveler generally includes a sliding leg member positioned within an outer sleeve member. The outer sleeve member is combined with a pair of brackets that encompass a portion of a ladder rail along with providing a notch in the brackets to receive a ladder rung. Generally, the brackets are positioned on one side of the sleeve member to permit easy removal of the leveler from the ladder. By positioning the two brackets on one side of the ladder, as easily as the device attaches to the ladder it will also fail to remain securely engaged upon the ladder. Therefore, in certain situations the ladder leveler will have a tendency to twist off of the ladder, resulting in a possible user accident.

It is therefore, an object of the present invention to provide a safe and easily installed ladder leveler for leveling a ladder positioned upon an uneven or inclined surface.

It is yet another object of the present invention to provide a ladder leveler which extends the length of a ladder rail by optimized incremental adjustments.

SUMMARY OF THE INVENTION

The present invention discloses a leveling device which may be removably attached to a ladder. The invention includes a hollow sleeve member of substantially rectangular cross-section having a pair of side walls joined by a pair of end walls. Each of the ends walls has a plurality of orifices or holes therein such that each orifice on one end walls is paired with an axially aligned orifice on the other end wall. A pair of substantially L-shaped brackets are each affixed to opposite ones of the end walls at opposite ends of the sleeve member. Each one of the L-shaped brackets consists of an arm member extending from a different one of the end walls and an ear member extending substantially perpendicular from the arm member. The ear members are inwardly opposed and spaced apart from the sleeve member by the arm members. The L-shaped bracket arrangement in combination with the sleeve member forms a region therebetween so as to receive a ladder therein. Each of the ear members contains a U-shaped notch for receiving a ladder rung. Spacing means are mounted upon the sleeve member for spacing the ladder rail apart from the sleeve member when it is received within the regions defined by the L-shaped bracket and the sleeve member. An extension member of I-shaped cross-section is slidably mounted within the sleeve member. The extension member has a pair of sides interconnected by a cross-web. Each one of the sides has a plurality of orifices therein such that each orifice on one side is pair with an axially aligned orifice on the other side. A retaining pin is provided so as to extend through a pair of end wall orifices and a pair of side orifices when axially aligned therebetween. The retaining pin is for selective adjustment and retaining of the extension member within the sleeve member.

BRIEF DESCRIPTION OF THE DRAWINGS

The features, objects and advantages of the invention will be more fully apparent from the detailed description set forth below, taken iin conjunction with the corresponding drawings in which like reference characters correspond throughout and wherein.

DETAILED DESCRIPTION OF THE PREFERRED EMBODIMENT

Figure 1:
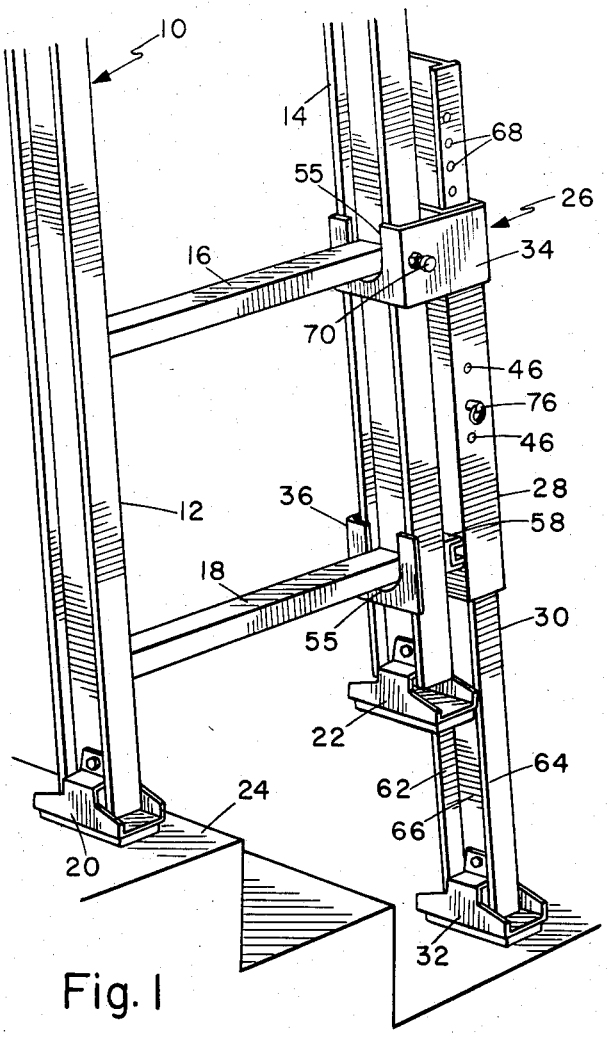
FIG. 1 is a perspective view showing the ladder extension in used on a ladder.

Referring to FIG. 1, there is illustrated the lower portion of the ladder 10 comprised of rails 12 and 14 and interconnecting rungs 16 and 18. In addition, the standard ladder has on each ladder rail, at a lower portion thereof, a foot, such as foot 20 on rail 12 and foot 22 on rail 14. In FIG. 1, ladder 10 is illustrated as being positioned on a set of steps 24, therefore creating an uneven surface for the ladder. Ladder leveler 26 is coupled with ladder 10 to effectively extend the length of rail 14 to compensate for the uneven surface upon which the ladder is situated. Ladder leveler 26 includes an outer sleeve member 28 and an extension member 30. Coupled at the lower portion of extension member 30 is foot 32. Foot 32 provides a gripping action so as to prevent the ladder leveler and ladder from slipping when a downward force, i.e., weight from a person climbing ladder 10, is applied. L-shaped brackets 34 and 36 are mounted to sleeve member 28 to receive a ladder rail 14 in the region defined by sleeve member 28 and L-shaped brackets 34 and 36. A U-shaped notch is provided on each of the L-shaped brackets to permit a rung to be supported by the L-shaped bracket.

Figure 2:
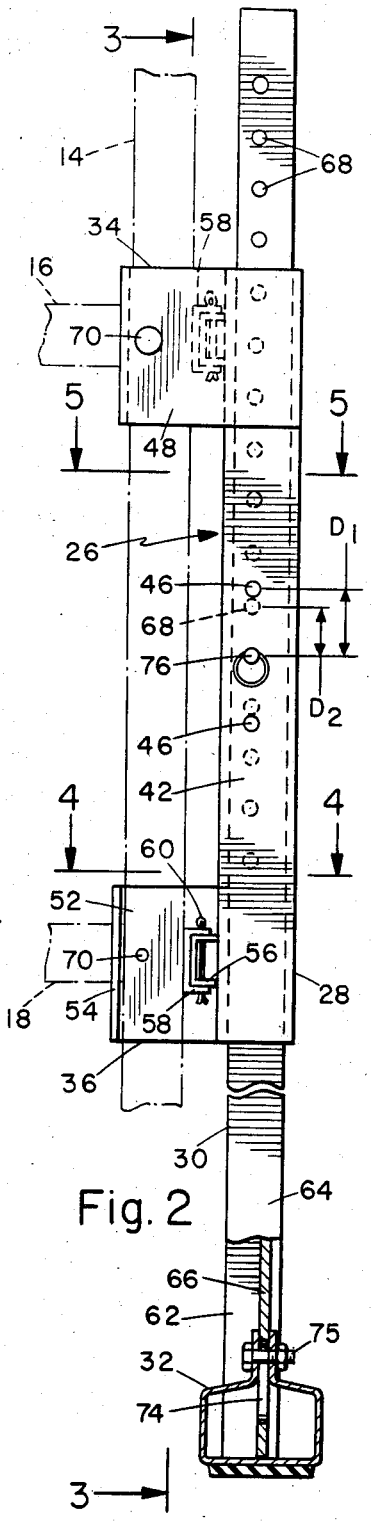
FIG. 2. is an enlarged side elevation view of the ladder extension.

FIG. 2 illustrates ladder 10 having ladder leveler 26 extending the length of rail 14 so that the ladder rails are kept in a vertical position. Sleeve member 28 is comprised of a pair of side walls 38 and 40 joined by a pair of end walls 42 and 44. End walls 42 and 44 each contain a plurality of orifices or holes 46 therein such that each orifice on end wall 42 is pair with an axially aligned orifice on end wall 44. Orifices 46 are spaced apart from each other by first distance $D_1$. It is preferred that sleeve member 28 be fabricated from a lightweight material such as extruded aluminum.

L-shaped bracket 36 is affixed to end wall 42 while L-shaped bracket 34 is affixed to end wall 44, at opposite ends of sleeve member 28. L-shaped brackets 34 and 36 may be either integrally formed with sleeve member 28 or permanently attached thereto by welding. Orifices 46 are located on sleeve member 28 between L-shaped brackets 34 and 36. L-shaped bracket 34 is comprised of arm member 48 and ear member 50. L-shaped bracket 36 is comprised of arm member 52 and ear member 54. Arm member 48 extends from end wall 42 where it is coupled to ear member 50. Ear member 50 extends perpendicularly from arm member 48. Arm member 52 extends from end wall 44 in the same direction as did arm member 48. Ear member 54 extends perpendicularly from arm member 52. Ear members 50 and 54 extend inwardly towards each other in an overlapping orientation. It is preferred that L-shaped brackets 34 and 36 be formed from a lightweight material such as aluminum.

Ear members 50 and 54 each have an upwardly facing U-shaped notch 55 formed therein for respectively receiving rungs 16 and 18. The region defined by L-shaped brackets 34 and 36 and sleeve member sidewall 38 is for receiving a ladder rail 14 therein.

Spacing means are mounted upon sleeve member 28 for spacing a ladder rail 14 apart from sleeve member sidewall 38. The spacing means comprises a pair of spacer blocks 56 mounted upon sidewall 38 within the region defined by sidewall 38 and L-shaped brackets 34 and 36. Removably coupled to spacer block 56 is channel member 58. Means are provided for retaining channel member 58 upon spacer block 56. Spacer block 56 may be formed from a channel shaped material having its open face affixed to side wall 38 while extending along side wall 38 from end wall 42 to end wall 44. Pin member 60 positioned through an aligned bore in spacer block 56 and channel member 58 provides a means for retaining channel member 58 upon space block 56. For a standard ladder, channel member 56 provides adequate spacing between ear member 54 to support a ladder rail 14 without excessive play therebetween. However, for a heavy-duty industrial ladder, channel member 58 is removed due to the increased rail width. In addition, the spacing means permits adequate spacing between foot 22 and extension member 30 to allowed unencumbered extension of extension member 30.

Extension member 30 is slidably mounted within sleeve member 28. Extension member 30 is comprised of a pair of sides 62 and 64 interconnected by a crossweb 66. Each of sides 62 and 64 contain a plurality of orifices or holes 68 therein such that each orifices on side 62 is paired with an axially aligned orifice on side 64. Each of the orifices 68 are equally spaced apart from each other by second distance $D_2$. It is preferred that extension member 30 be fabricated from a lightweight material such as extruded aluminum.

In the preferred embodiment of the invention there are three sets of paired orifices 46 in sleeve member 28. Each set of paired orifices 46 are equally spaced apart by the distance $D_1$ which is greater than the distance $D_2$. In the preferred embodiment, the distance D1 is 1 ¼ inches and the distance D2 is 1 inch. The distances $D_1$ and $D_2$ are measured from the center to center of adjacent orifices. By having distances $D_1$ and $D_2$ unequal, an optimum incremental adjustment of extension member 30 within sleeve member 28 is provided. Using the dimensions of the preferred embodiment of the invention, adjustments are made in ⅛ inch increments.

Figure 4:
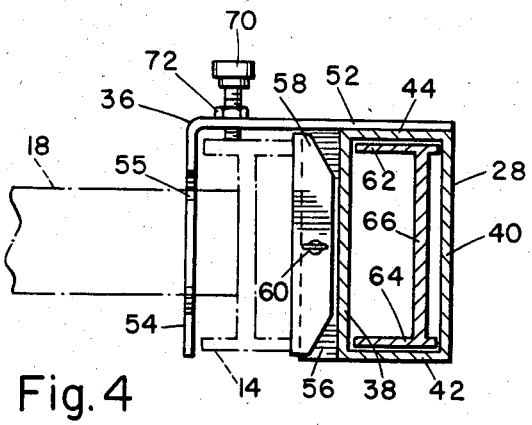
FIG. 4 is an enlarged sectional view taken on line 4—4 of FIG. 2.
Figure 3:
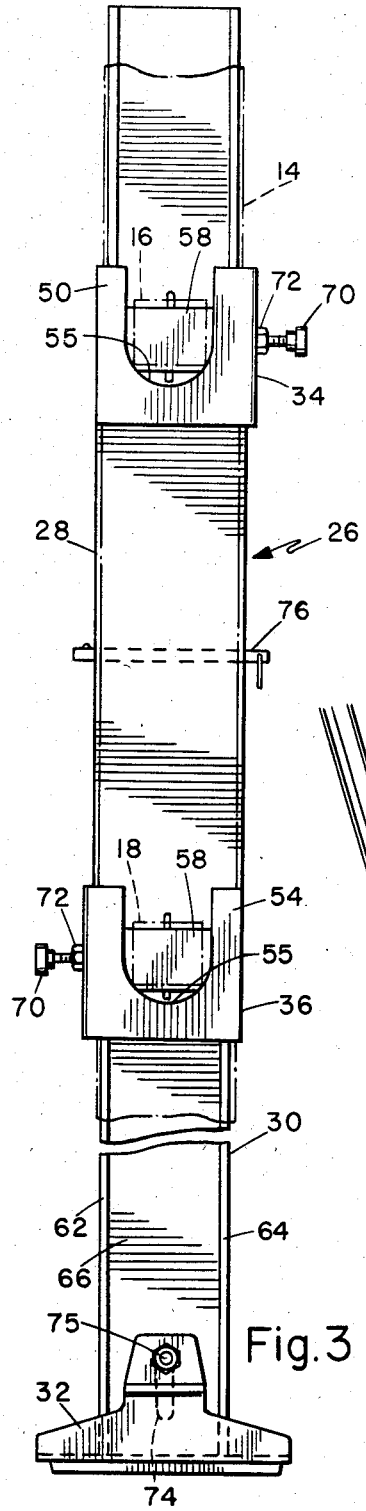
FIG. 3 is a view taken on line 3—3 of FIG. 2.

Referring to FIGS. 3 and 4, there is illustrated a rail retaining means comprising a lockscrew 70 threadably mounted in each of the L-shaped brackets. L-shaped bracket may have a threaded bore in the arm member or have a locknut 72 secured to the arm member aligned with a straight bore. Lockscrew 70 advances through the threaded bore or locknut 72 engaging a ladder rail. The force of the lockscrew places pressure upon a ladder rail to force the ladder rung against an inner wall of the ear member U-shaped notch. The rail retaining means provides additional securing forces which prevent accidental removal of the ladder leveler from the ladder.

The lower portion of extension member 30 is provided with a slot 74 through which foot 32 is pivotally pinned by bolt 75, or similar means. The use of slot 74 permits foot 32 to slide within the slot such that the bottom of extension member 30 directly contacts the lower portion of foot 32. This relieves force from the pin portion of the foot and places weight directly upon the lower portion of the foot.

FIG. 4 illustrates extension member 30 slidably mounted within sleeve member 28. Rail 14 is engaged between L-shaped bracket 36 and channel member 58. Channel member 58 is supported by spacer block 56 which is mounted upon sleeve member 28 at side wall 38. An aligned bore is provided through channel member 58 and spacer block 56. Pin member 60 is inserted through the aligned bore to retain channel member 58 upon spacer block 56.

Figure 5:
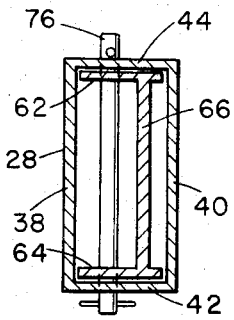
FIG. 5 is an enlarged sectional view taken on line 5—5 of FIG. 2.

FIG. 5 illustrates the relationship of retaining pin 76 extending through the aligned orifices in sleeve member 28 and cross member 30. As can be seen in FIG. 5, sleeve member 28 is rectangular in cross-section while extension member 30 is of I-shaped cross-section.

Figure 6:
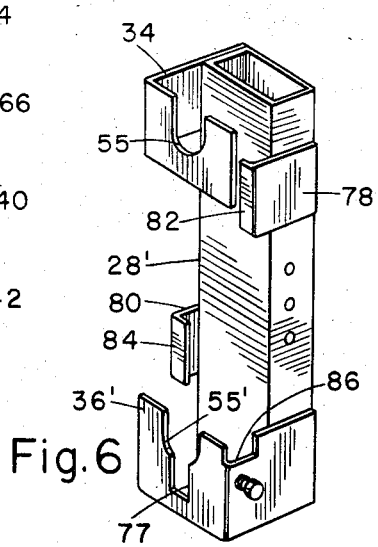
FIG. 6 is a perspective view of a modified sleeve member for use with a fiberglass ladder.

FIG. 6 illustrates a sleeve member 28' modified to receive a fiberglass ladder. L-shaped bracket 34 is unchanged while L-shaped bracket 36' is provided with a downwardly extending slot 77 to receive the lower reinforced rung of a fiberglass ladder. The additional slot in the U-shaped notch 55' of L-shaped bracket 36' permits even distribution of forces upon the L-shaped bracket in addition to providing a contoured coupling region. The downwardly extending slot 77 is narrower in width than the U-shaped notch 55'. Notch 86 is provided in L-shaped bracket 36' to permit unencumbered installation of the ladder leveler upon a fiberglass ladder. Sleeve member 28 further includes spacing means comprising spacer members 78 and 82 mounted on opposite end walls of sleeve member 28. Spacer members 78 and 82 extend from sleeve member 28 in the same direction as L-shaped brackets 34 and 36'. At the end of respective spacer members 78 and 82 are inwardly facing flanges 80 and 84. Spacer members 78 and 82 provide the spacing necessary to permit a secured yet unencumbered coupling of the ladder leveler with a fiberglass ladder.

Figure 7:
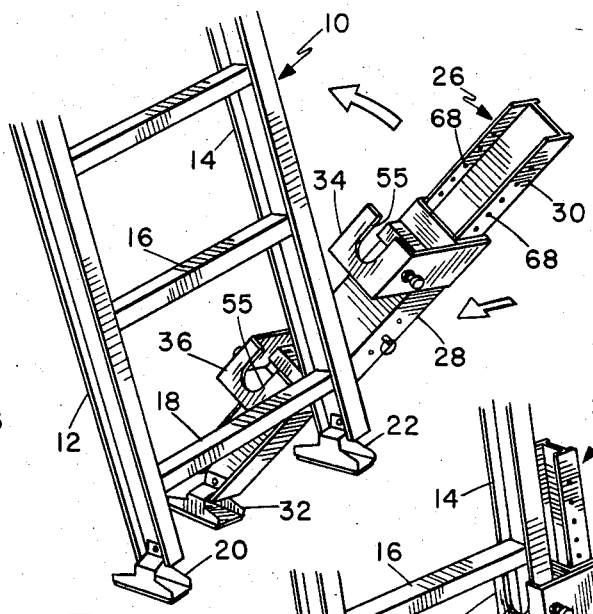
FIG. 7 illustrates the initial step of engaging the ladder extension with a ladder.
Figure 8:
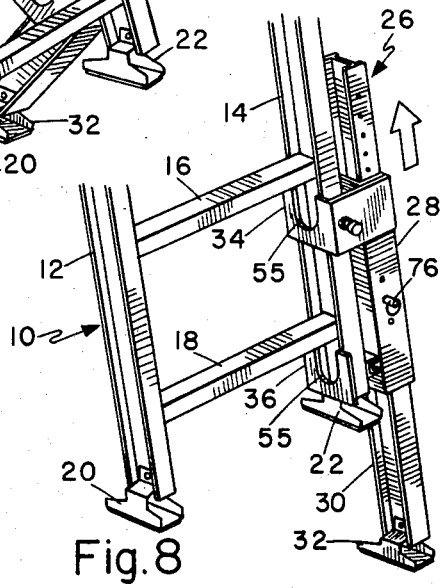
FIG. 8 shows the ladder extension engaged prior to locking in place.

FIGS. 7 and 8 illustrate in perspective view the installation of ladder leveler 26 upon ladder 10. In FIG. 7 ladder leveler 26 is placed adjacent ladder rail 14. Ladder leveler 26 is pivoted about a point centrally located on sleeve member 28 between L-shaped brackets 34 and 36. Sleeve member 28 is positioned so that upon pivoting ladder rail 14 is received between the region defined by L-shaped brackets 34 and 36 and sleeve member 28. Ladder rail 14 is spaced apart from sleeve member 28 by channel members 58 mounted upon spacer blocks 56. Hence, ladder leveler 26 has been positioned such that L-shaped brackets 34 and 36 are respectively located beneath ladder rungs 16 and 18.

FIG. 8 illustrates the ladder leveler 26 coupled to ladder 10 in position for adjustment of extension member 30 and sleeve member 28. This adjustment provides the proper rail extension to assure vertical placement of the ladder rails. Retaining pin 76 is removed from the axially aligned orifices of sleeve member 28 and extension member 30 thereby permitting sliding movement between sleeve member 28 and extension member 30. Sleeve member 28 is moved upward to permit ladder rungs 16 and 18 to be respectively received in the U-shaped notches of L-shaped brackets 34 and 36. Retaining pin 76 is reinserted through the axially aligned orifices in sleeve member 28 and extension member 30 so as to properly couple ladder leveler 26 upon ladder 10 as illustrated in FIG. 1. Lockscrews 70 are turned in locknuts 72, located on L-shaped brackets 34 and 36, so as to engage lockscrews 70 with ladder rail 14. The tightening of lockscrews 70 to provide additional coupling strength for ladder leveler 26 upon ladder 10.

The previous description of the prefferred embodiments are provided to enable an person skilled in the art to make or use the present invention. Various modifications to these embodiments may be readily apparent to those skilled in the art, and the generic principle defined herein may be applied to other embodiments without the use of the inventive facilities. Thus, the present invention is not intended to be limited to the embodiment shown herein but is to be accorded the widest scope consistent with the principles and novel features disclosed herein.

We claim:

1. A leveling device for removable attachment to a ladder comprising:

a hollow sleeve member of substantially rectangular cross-section having a pair of side walls joined by a pair of end walls each having a plurality of orifices therein such that each orifice on one end wall is paired with an axially aligned orifice on the other end wall;

a pair of substantially L-shaped brackets each affixed to opposite ones of said end walls at opposite ends of said sleeve member, each one of said L-shaped brackets having an arm member extending from a different one of said end walls and an ear member extending substantially perpendicular from said arm member, said ear members being inwardly opposed and spaced apart from said sleeve member by said arm members so as to receive a ladder rail therebetween and each of said ear members having a U-shaped notch for receiving a ladder rung therein;

spacing means secured to said sleeve member for engaging and holding a ladder rail apart from said sleeve member when received within the regions defined by said L-shaped brackets and said sleeve member;

an extension member of I-shaped cross-section slidably mounted within said sleeve member, said extension member having a pair of sides interconnected by a cross-web, each one of said sides having a plurality of orifices therein such that each orifice on one side is paired with an axially aligned orifice on the other side;

a retaining pin, extending through a pair of end wall orifices and a pair of side orifices when axially aligned therebetween for selectively retaining said extension member within said sleeve member;

a foot member pivotally connected to a lower portion of said extension member; and wherein said plurality of orifices located in said end walls are equally spaced apart by a first distance and said plurality of orifices in said sides are equally spaced apart by a second distance, said first and second distances being unequal.

2. The leveling device of claim 1 wherein said spacing means comprises:

a pair of spacer blocks mounted upon said sleeve member at a side wall facing said ear members;

a pair of channel members each removably coupled to one of said spacer blocks; and means for retaining said channel members upon said spacer blocks.

3. The leveling device of claim 2 further comprising rail retaining means for retaining a ladder rail in said regions defined by said L-shaped brackets and said sleeve member.

4. The leveling device of claim 3 wherein said rail retaining means comprises a lockscrew threadably mounted in each of said L-shaped brackets and said sleeve member.

5. The leveling device of claim 1 wherein said spacing means comprises a pair of spacer members each fixed to and extending from opposite ones of said end walls, each spacer member having an inwardly extending flange at an end of said spacer members opposite said end walls.

6. The leveling device of claim 5 wherein at least one of said ear members has a slot extending downwardly from the lower curved portion of said U-shaped notch, said slot being narrower in width than said U-shaped notch.

7. The leveling device of claim 6 further comprising rail retaining means for retaining a ladder rail in said regions defined by said L-shaped brackets and said sleeve member.

8. The leveling device of claim 7 wherein said rail retaining means comprises a lockscrew threadably mounted in each of said arm members for engagement with a ladder rail.

9. The leveling device of claim 5 further comprising rail retaining means for retaining a ladder rail in said regions defined by said L-shaped brackets and said sleeve member.

10. A ladder leveler for removable attachment to a ladder comprising:

a hollow sleeve member of substantially rectangular cross-section having a pair of side walls joined by a pair of end walls each having at least two holes equally spaced apart by a first distance and each hole on one end wall being paired with an axially aligned hole on the other end wall;

a pair of substantially L-shaped brackets each affixed to opposite ones of said end walls at opposite ends of said sleeve member, each one of said L-shaped brackets having an arm member extending substantially parallel from a different one of said end walls, said arm members extending in the same direction from said end walls, and an ear member extending substantially perpendicular from said arm member, said ear members being inwardly opposed and spaced apart from said sleeve member by said arm members so as to receive a ladder rail therebetween and each of said ear members having a U-shaped notch for receiving a ladder rung therein;

spacing means secured to said sleeve member within the regions defined by said L-shaped brackets and said sleeve member for engaging and holding a ladder rail apart from said sleeve member when received within the regions defined by said L-shaped brackets and said sleeve member;

an extension member of I-shaped cross-section slidably mounted within said sleeve member, said extension member having a pair of sides interconnected by a cross-web, each one of said sides having a plurality of holes equally spaced apart by a second distance, said second distance being unequal with said first distance such that said first distance is greater than said second distance, each hole on one side is paired with an axially aligned hole on the other side;

a retaining pin extending through a pair of end wall holes and a pair of side holes when axially aligned therebetween for selectively retaining said extension member within said sleeve member; and a foot member pivotally connected to a lower portion of said extension member.

11. The ladder leveler of claim 10 wherein said spacing means comprises:

a pair of spacer members affixed upon said sleeve member extending between end walls along a side wall facing said ear members, each spacer member being located within the region defined one of said L-shaped brackets and said sleeve member and each spacing member having a bore therethrough;

a pair of channel member each removably coupled to one of said spacer members, each channel member having a pair of axially aligned holes in opposite sides of said channel member; and a retaining pin extending through said pair of holes in opposite sides of said channel member and said spacer member bore when axially aligned therebetween for retaining said channel member upon said spacer member.

12. The ladder leveler of claim 11 further comprising a lockscrew threadably mounted in each of said arm members for engagement with a ladder rail.

13. The ladder leveler of claim 10 wherein said spacing means comprises a pair of spacer members each extending from opposite ones of said end walls in the same direction from said end walls as said arm members, each spacer member having an inwardly extending flange at an end of said spacer members opposite said end walls.

14. The ladder leveler of claim 13 wherein the ear member located at a lower end of said sleeve member has a rectangular slot extending downwardly from the lower curved portion of said U-shaped notch, said slot being narrower in width than said U-shaped notch.

15. The ladder leveler of claim 14 further comprising a lockscrew threadably mounted in each of said arm members for engagement with a ladder rail.

16. The ladder leveler of claim 13 further comprising a lockscrew threadably mounted in each of said arm members for engagement with a ladder rail.

* * * * *